US008596069B2

(12) United States Patent
Shershnyov et al.

(10) Patent No.: US 8,596,069 B2
(45) Date of Patent: Dec. 3, 2013

(54) RATIONAL LATE LEAN INJECTION

(75) Inventors: Borys Borysovich Shershnyov, Moscow (RU); Leonid Yul'evich Ginesin, Moscow (RU); Krishnakumar Venkataraman, Simpsonville, SC (US)

(73) Assignee: General Electric Company, Schenectady, NY (US)

( * ) Notice: Subject to any disclaimer, the term of this patent is extended or adjusted under 35 U.S.C. 154(b) by 26 days.

(21) Appl. No.: 13/349,923

(22) Filed: Jan. 13, 2012

(65) Prior Publication Data

US 2013/0180255 A1 Jul. 18, 2013

Related U.S. Application Data

(63) Continuation of application No. PCT/RU2011/000464, filed on Jun. 28, 2011.

(51) Int. Cl.
*F02C 3/00* (2006.01)

(52) U.S. Cl.
USPC ..... 60/733

(58) Field of Classification Search
USPC ..... 60/733, 737–740, 746, 748
See application file for complete search history.

(56) References Cited

U.S. PATENT DOCUMENTS

| | | | | |
|---|---|---|---|---|
| 3,925,002 | A * | 12/1975 | Verdouw | 431/10 |
| 3,991,560 | A | 11/1976 | DeCorso et al. | |
| 4,040,252 | A | 8/1977 | Mosier et al. | |
| 4,112,676 | A | 9/1978 | DeCrso | |
| 4,928,481 | A * | 5/1990 | Joshi et al. | 60/737 |
| 5,797,267 | A * | 8/1998 | Richards | 60/737 |
| 5,802,854 | A | 9/1998 | Maeda et al. | |
| 6,209,325 | B1 | 4/2001 | Alkabie | |
| 6,324,828 | B1 * | 12/2001 | Willis et al. | 60/773 |
| 6,532,742 | B2 * | 3/2003 | Scarinci et al. | 60/725 |
| 6,691,515 | B2 * | 2/2004 | Verdouw et al. | 60/737 |
| 8,281,594 | B2 * | 10/2012 | Wiebe | 60/733 |
| 8,381,532 | B2 * | 2/2013 | Berry et al. | 60/795 |
| 2001/0049932 | A1 | 12/2001 | Beebe | |
| 2007/0089419 | A1 * | 4/2007 | Matsumoto et al. | 60/737 |
| 2010/0242482 | A1 * | 9/2010 | Kraemer et al. | 60/746 |
| 2011/0179803 | A1 * | 7/2011 | Berry et al. | 60/785 |

FOREIGN PATENT DOCUMENTS

| | | | |
|---|---|---|---|
| EP | 1108957 | A1 | 6/2001 |
| GE | 2280022 | A | 1/1995 |

OTHER PUBLICATIONS

Search Report and Written Opinion from PCT Application No. PCT/RU2011/000464 dated Apr. 27, 2012.

* cited by examiner

*Primary Examiner* — Phutthiwat Wongwian
(74) *Attorney, Agent, or Firm* — Cooper Legal Group, Inc.

(57) ABSTRACT

A combustor section of a gas turbine includes a combustor liner, a sleeve and a fuel-air mixing tube. The combustor liner defines a combustion chamber. The sleeve surrounds the combustor liner. The combustor liner and the sleeve define an annular flow space. The fuel-air mixing tube is configured to channel a mixture of fuel and air and includes an inlet and an outlet. The inlet is in fluid communication with an exterior of the sleeve, and the outlet is in fluid communication with the combustion chamber. The combustor casing encloses the combustor section upstream relative to the inlet of the mixing tube and extends downstream. The sleeve and the combustor casing define a discharge air space. The discharge space is in fluid communication with the mixing tube. The fuel supplying device is located exteriorly of the combustor casing and is configured to inject fuel into the mixing tube.

20 Claims, 4 Drawing Sheets

RATIONAL LATE LEAN INJECTION

BACKGROUND OF THE INVENTION

The present disclosure relates generally to gas turbines, and more particularly, apparatuses and methods for forming a mixture of fuel and air and routing the mixture for combustion inside the gas turbine.

Large scale combustion applications, such as gas turbines, can emit a significant amount of nitrogen oxides ($NO_X$) into the atmosphere. These emissions are not only harmful to the environment but there may be environmental regulations restricting or preventing the operation of the combustion applications unless the emission amounts are lowered to acceptable levels. Thus, there is a need for combustion applications that can operate while keeping the amount of $NO_X$ emissions at low levels.

BRIEF DESCRIPTION OF THE INVENTION

The following presents a simplified summary of the invention in order to provide a basic understanding of some example aspects of the invention. This summary is not an extensive overview of the invention. Moreover, this summary is not intended to identify critical elements of the invention nor delineate the scope of the invention. The sole purpose of the summary is to present some concepts of the invention in simplified form as a prelude to the more detailed description that is presented later.

In accordance with one aspect, a combustor section of a gas turbine includes a primary combustor liner, a secondary combustor liner, a primary sleeve, a secondary sleeve, and a fuel-air mixing tube. The primary combustor liner defines a primary combustion chamber. The secondary combustor liner defines a secondary combustion chamber and is connected to the primary combustor liner in fluid communication therewith. The primary sleeve surrounds the primary combustor liner. The secondary sleeve surrounds the secondary combustor liner and is connected to the primary sleeve. The combustor liners and the sleeves define an annular flow space therebetween. The fuel-air mixing tube is configured to channel a mixture of fuel and air and includes an inlet and an outlet. The inlet is in fluid communication with an exterior of the primary sleeve, and the outlet is in fluid communication with the secondary combustion chamber.

In accordance with another aspect, a gas turbine includes a combustor section, a combustor casing and a fuel supplying device. The combustor section includes a combustor liner, a sleeve and a fuel-air mixing tube. The combustor liner defines a combustion chamber. The sleeve surrounds the combustor liner. The combustor liner and the sleeve define an annular flow space therebetween. The fuel-air mixing tube is configured to channel a mixture of fuel and air and includes an inlet and an outlet. The inlet is in fluid communication with an exterior of the sleeve, and the outlet is in fluid communication with the combustion chamber. The combustor casing encloses the combustor section upstream relative to the inlet of the mixing tube and extends downstream therefrom. The sleeve and the combustor casing define a discharge air space therebetween. The discharge air space is in fluid communication with the fuel-air mixing tube. The fuel supplying device is located exteriorly of the combustor casing and is configured to inject fuel into the fuel-air mixing tube.

In accordance with yet another aspect, a method of supplying a mixture of fuel and air to a combustor section of a gas turbine is provided. The combustor section includes a primary combustor liner, a secondary combustor liner, a primary sleeve, a secondary sleeve. The primary combustor liner defines a primary combustion chamber. The secondary combustor liner defines a secondary combustion chamber and is connected to the primary combustor liner in fluid communication therewith. The primary sleeve surrounds the primary combustor liner. The secondary sleeve surrounds the secondary combustor liner and is connected to the primary sleeve. The combustor liners and the sleeves define an annular flow space therebetween. The method includes the steps of providing a mixing tube including an inlet and an outlet. The inlet is in fluid communication with an exterior of the primary sleeve. The outlet is in fluid communication with the secondary combustion chamber. The method further includes supplying fuel and air to the inlet.

BRIEF DESCRIPTION OF THE DRAWING

The foregoing and other aspects of the present invention will become apparent to those skilled in the art to which the present invention relates upon reading the following description with reference to the accompanying drawings, in which.

DETAILED DESCRIPTION OF THE INVENTION

Figure 1:
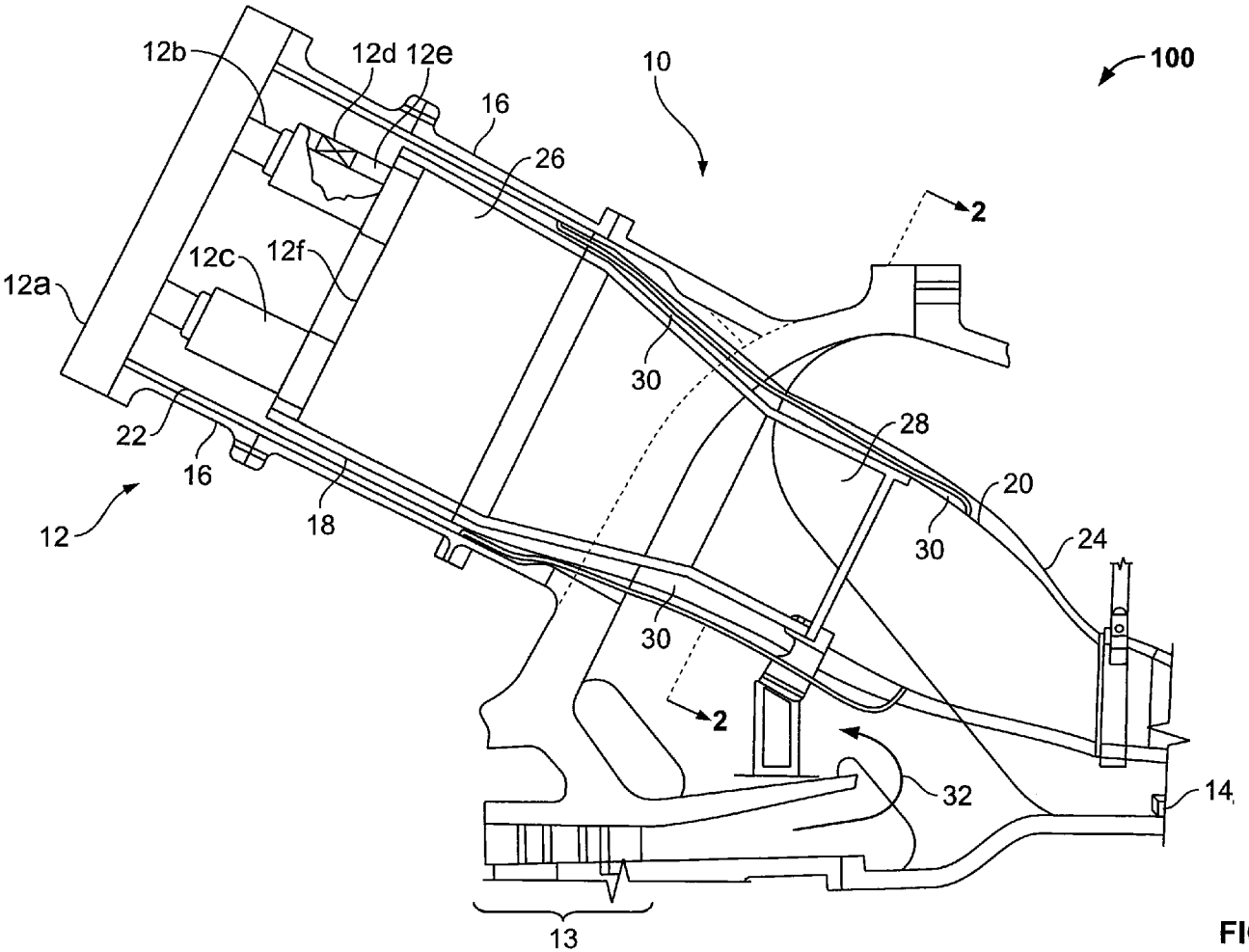
FIG. 1 shows an axially-oriented, cross-sectional view of an example embodiment of a combustor section of a gas turbine implemented with a plurality of fuel-air mixing tubes.

Examples of embodiments that incorporate one or more aspects of the present invention are described and illustrated in the drawings. These illustrated examples are not intended to be a limitation on the present invention. For example, one or more aspects of the present invention can be utilized in other embodiments and even other types of devices.

Turning to the shown example of FIG. 1, an axially-oriented, cross-sectional view across an example embodiment of a combustor section 10 of a gas turbine 100 is provided. The gas turbine 100 may include a plurality of combustor sections 10 that are circumferentially spaced apart in a circular array. The example combustor section 10, which is of a can-annular, reverse-flow type, includes a head end 12 at an upstream end and leads to a turbine section 14 in the downstream direction. The head end 12 includes a variety of features such as an end cover 12*a*, start-up fuel nozzles 12*b*, premixing fuel nozzles 12*c*, a swirler 12*d*, fuel spokes 12*e* and a cap assembly 12*f* although various configurations of fuel injection means may be used. The combustor section 10 may also include, among other things, a combustor casing 16, a primary combustor liner 18, a secondary combustor liner 20 (i.e., a transition piece), a primary sleeve 22 (i.e., a cylindrical flow sleeve), and a secondary sleeve 24 (i.e., an impingement sleeve). The primary combustor liner 18 defines a primary combustion chamber 26 while the secondary combustor liner 20 defines a secondary combustion chamber 28. The primary, combustor liner 18 is coupled to the secondary combustor liner 20 such that the two combustion chambers 26, 28 are in fluid communication therewith. The primary sleeve 22 and the secondary sleeve 24 are coupled with one another and surround the primary combustor liner 18 and the secondary combustor liner 20 respectively. An annular flow space 30 is formed by the gap between the sleeves 22, 24 and combustor liners 18, 20.

The combustor casing 16 is located exteriorly of the sleeves 22, 24 and encloses a part of the combustor section 10. The space between the combustor casing 16 and the sleeves 22, 24 is a discharge air space 32 (i.e., a compressor discharge cavity) through which air discharged from the compressor section 13 is channeled for entry into the combustion chambers 26, 28. In the reverse-flow type combustors, air 2 discharged from a compressor section of the gas turbine 100 moves upstream either through the discharge air space 32 or the annular flow space 30 and enters the combustion chamber. The primary and secondary sleeves 22, 24 include holes through which the air 2 from the discharge air space 32 can enter the annular flow space 30. The air 2 then travels upstream toward the primary combustor liner 18 which also includes holes allowing the air 2 to enter the primary combustion chamber 26. The air 2 from the compressor section has the dual purposes of cooling the components of the combustor section 10 and providing air 2 needed for combustion. The air 2 that enters the primary combustion chamber 26 mix with the fuel 4 injected by the nozzles, and the mixture 6 is ignited inside the primary combustion chamber 26. However, the primary portion of discharge air 2 enters the combustion chambers 26, 28 as a fuel-air mixture through the nozzles 12*b*, 12*c* in the head end 12. The fuel-air mixture 6 is different in that the mixture 6 is produced by a secondary or late injection of fuel 4. The working gases resulting from the combustion drive one or more rows of blades in the turbine section 14.

Figure 2:
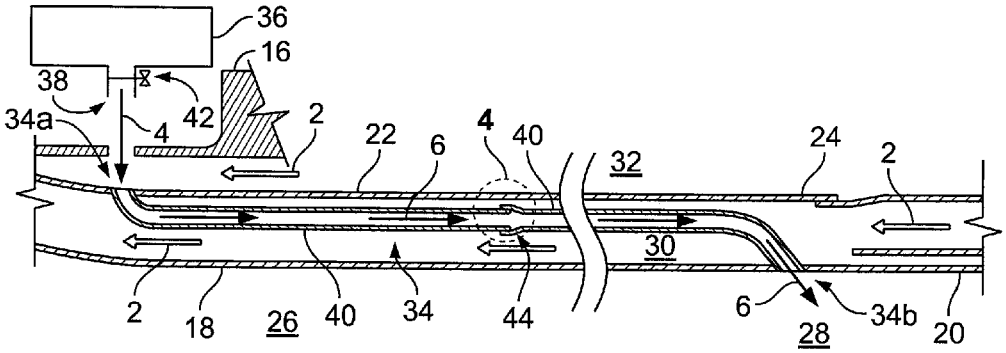
FIG. 2 shows a cross-sectional view of a first embodiment of the fuel-air mixing tube.
Figure 3:
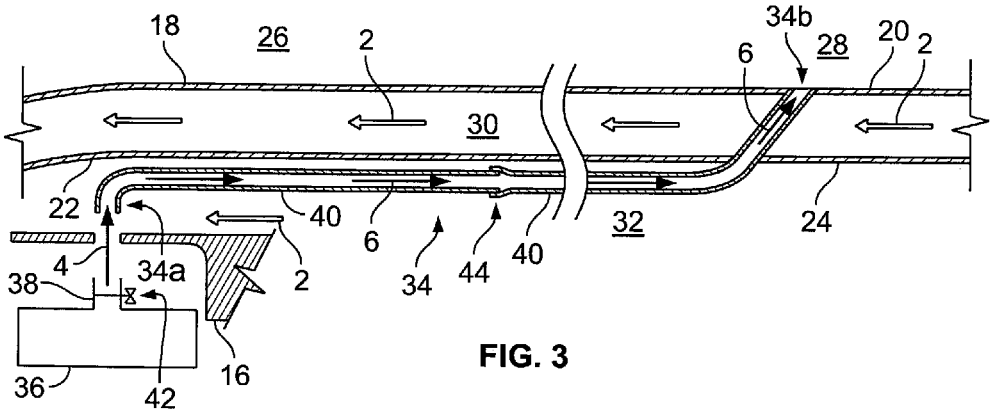
FIG. 3 shows a cross-sectional view of a second embodiment of the fuel-air mixing tube.
Figure 5:
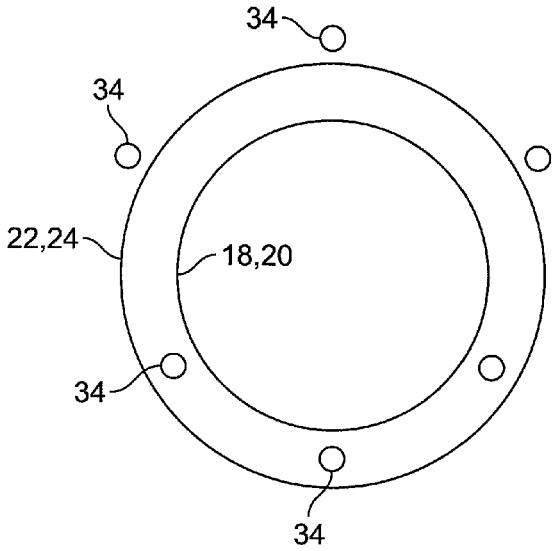
FIG. 5 shows a radially-oriented, cross-sectional view of the example embodiment of the combustor section with a first example arrangement of the fuel-air mixing tubes.
Figure 6:
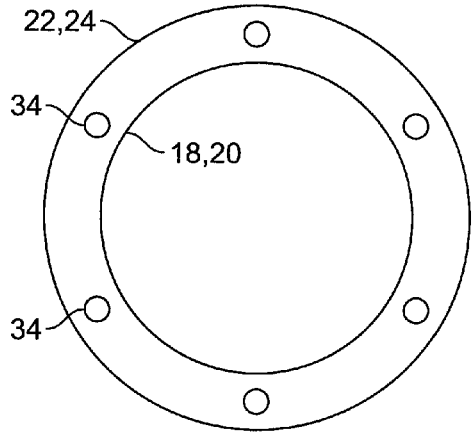
FIG. 6 shows a radially-oriented, cross-sectional view of the example embodiment of the combustor section with a second example arrangement of the fuel-air mixing tubes.
Figure 7:
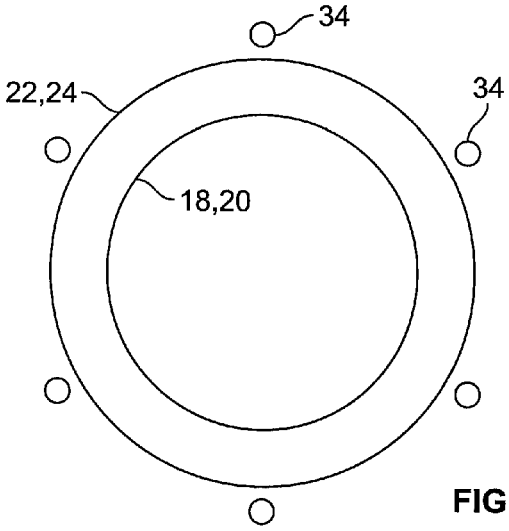
FIG. 7 shows a radially-oriented, cross-sectional view of the example embodiment of the combustor section with a third example arrangement of the fuel-air mixing tubes.

A plurality of fuel-air mixing tubes 34 may be disposed peripherally about the combustor section 10, two of which are shown in FIG. 1. The example combustor section 10 in FIG. 1 is configured with multiple embodiments of the mixing tube 34 which are shown schematically. FIG. 5 illustrates a cross-sectional view of the arrangement of the mixing tubes 34 about the combustor section 10 in FIG. 1. In this embodiment, some of the mixing tubes 34 are inside the annular flow space 30 while the rest of the mixing tubes 34 are to the exterior of the annular flow space 30. As shown in FIG. 5, the plurality of mixing tubes 34 may be scattered substantially evenly in terms of angular position about the periphery of the combustor section 10. However, the number of mixing tubes 34 and their arrangement about the periphery of the combustor section 10, with respect to the annular flow space 30 or in terms of angular position, may vary. FIGS. 2 and 3 show the two arrangements of mixing tube 34 in more detail. It must be noted that, while the combustor section 10 may include mixing tubes 34 that are arranged in part inside the annular flow space 30 and in part outside the annular flow space 30 as shown in FIG. 5, all of the mixing tubes 34 may inside the annular flow space 30 (FIG. 6) or outside the annular flow space 30 (FIG. 7).

Figure 8:
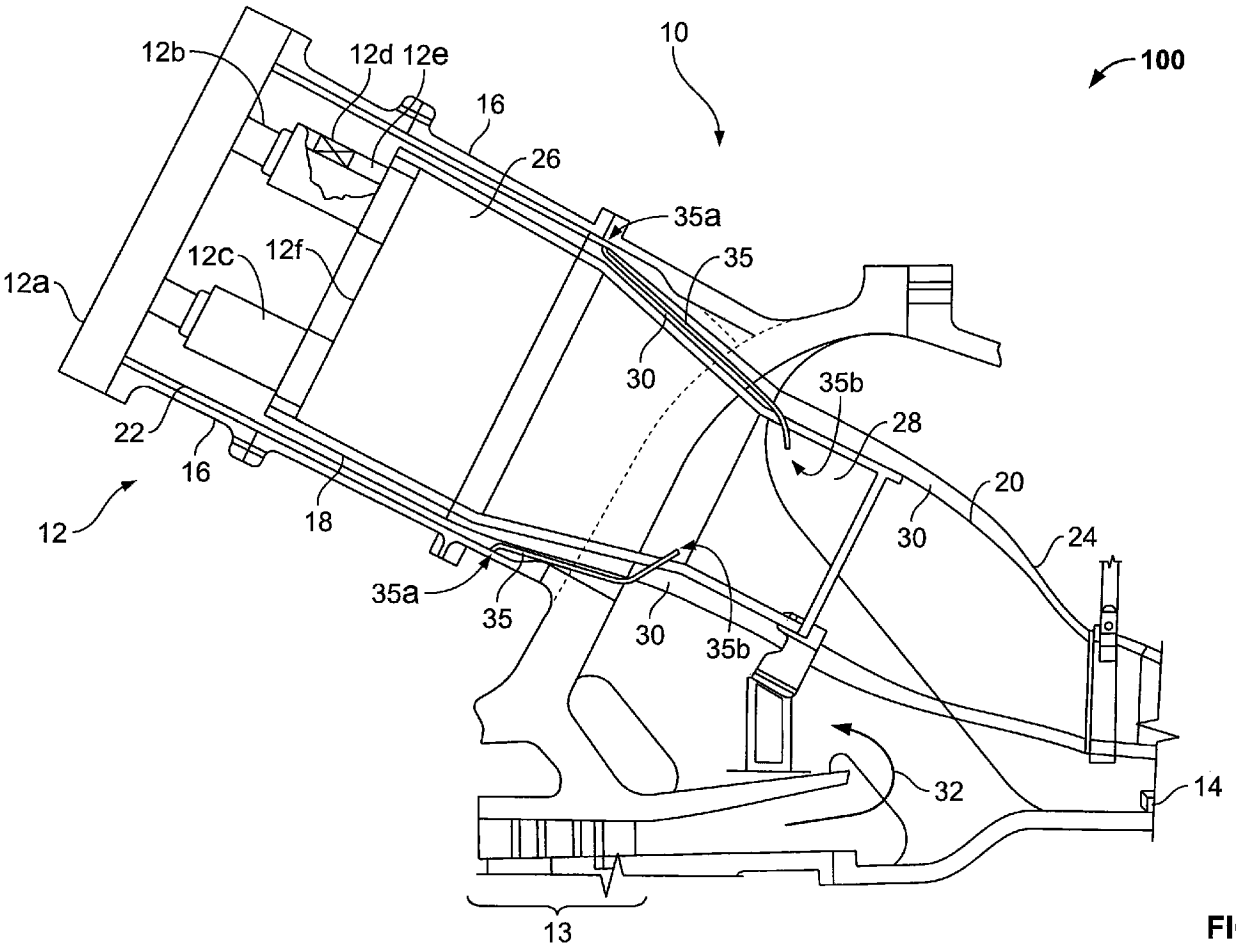
FIG. 8 show an axially oriented, cross-sectional view of an alternative example embodiment of the combustor section of the gas turbine implemented with alternative embodiments of the fuel-air mixing tubes.

FIG. 2 shows a first embodiment of the mixing tube 34 a substantial portion of which is routed within the annular flow space 30 between the sleeves 22, 24 and the liners 18, 20. In the embodiment of FIG. 2, the mixing tube 34 is entirely within annular flow space 30. FIG. 3 shows a second embodiment of the mixing tube 34 a substantial portion of which is routed outside the annular flow space 30 and exteriorly to the sleeves 22, 24. In the embodiment of FIG. 3, the mixing tube 34 is in part within the annular flow space 30 and in part outside the annular flow space 30. Each mixing tube 34 includes an inlet 34*a* that is provided with fuel 4 and air 2, and an outlet 34*b* that is in fluid communication with the secondary combustion chamber 28. However, in an alternative embodiment of the mixing tube 35, shown in FIG. 8, the outlet of the mixing tube 35 can also be configured to be in fluid communication with the primary combustion chamber 26 at a downstream part thereof. The inlet 34*a* of the mixing tube 34 may be formed near the head end 12 of the combustor section 10 and thus may be formed on the primary sleeve 22 (FIG. 2) or in proximity thereto (FIG. 3). For example, the mixing tube 34 may be routed through the primary sleeve 22 and the inlet 34*a* may be formed exteriorly of the primary sleeve 22. The outlet 34*b* may be formed near the turbine section 14 of the gas turbine 100 and thus may be configured on the secondary combustor liner 20 or in proximity thereof. For example, the outlet 34*b* may be formed such that the outlet end of the mixing tube 34 is routed through the secondary sleeve 24 and projects into the secondary combustion chamber 28.

The combustor casing 16 is configured about the sleeves 22, 24 such that the inlet 34*a* of the mixing tube 34 is in fluid communication with the exterior of the primary sleeve 22 and thus the discharge air space 32. Thus, the combustor casing 16 encloses the combustor section 10 at a location that is upstream relative to the location of the inlet 34*a* of the mixing tube 34 and extends downstream therefrom. The combustor casing 16 may be part of an outer shell of the gas turbine 100. The pressure gradient in the discharge air space 32 is such that the discharged air 2 moves upstream along the exterior of the sleeves 22, 24 or the exterior of the combustor liners 18, 20 in case the air 2 passes through the holes formed on the sleeves 22, 24. Thus, the tendency of the discharged air 2 to move toward the combustion chambers 26, 28 will cause a portion of it to enter the inlet 34*a* of the mixing tube 34 and move therethrough. Moreover, a fuel-supplying device 36 is provided exteriorly the combustor casing 16 and may include an injector 38 feeding fuel 4 into the inlet 34*a*. The fuel-supplying device 36 may be provided independently of a main fuel-supplying device which may be located at the head end 12 to provide fuel 4 to the primary combustion chamber 26. Alternatively, the fuel-supplying device 36 may simply function to channel fuel 4 from the main fuel-supplying device to the injector 38 and, for example, may be embodied as a manifold. The fuel-supplying device 36, in its entirety or in part, may be located exteriorly of the combustor casing 16 to reduce its exposure to the high temperatures in and around the combustor section 10. The injector 38, which is schematically shown in FIGS. 2 and 3, may be embodied in a variety of configurations that allow fuel 4 and air 2 to enter the inlet 34*a* of the mixing tube 34. For example, the injector 38 may include a nozzle-like feature that is located at a predetermined distance from the inlet 34*a* and sprays fuel 4 into the inlet 34*a* from a distance while allowing the discharged air 2 to enter the inlet 34*a* as well. If multiple mixing tubes 34 are provided peripherally about the combustor section 10, each mixing tube 34 may be provided with one fuel-supplying device 36 or one injector 38.

Figure 4:
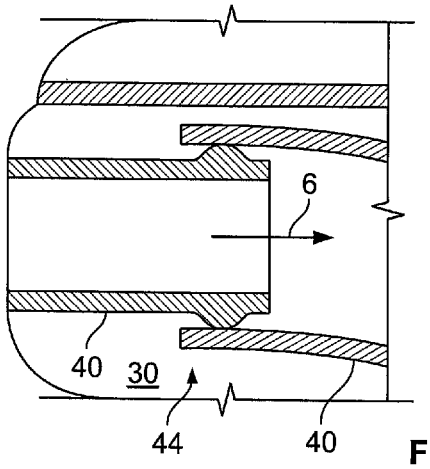
FIG. 4 shows a cross-sectional view of a joint coupling two tube segments.

As shown in FIGS. 2-4, the mixing tube 34 is formed of a plurality of tube segments 40 to allow for thermal expansion and reduce the effect of thermal stress on the mixing tube 34 which is located near regions of high temperature. The tube segments 40 are coupled using joints 44 that are movable, as shown in FIG. 4, to prevent the mixture 6 of fuel 4 and air 2 from leaking and to be movable about one another. For example, the tube segments 40 may be coupled and sealed by way of such as spherical joints, piston rings, bearings or the like. Moreover, because the fuel-air mixing tube 34 is directed to enhancing the mixing of the fuel 4 and air 2 as they travel throughout the mixing tube 34, the mixing tube 34 will be sufficiently long to obtain a desired level of mixing. For example, the ratio of the length to the diameter of the mixing tube 34 may be about 20. Each tube segment 40 may be supported on an adjacent component of the combustor section 10, such as the sleeves 22, 24 or the liners 18, 20, by way of means known in the art, such as brackets. For example, the primary sleeve 22 may be configured to support one tube segment 40 while the secondary sleeve 24 is configured to support another tube segment 40.

The fuel-air mixing tube 34 need not be in constant operation during operations of the gas turbine 100. When the load on the gas turbine 100 is below a predetermined level (e.g., 80% of base load), it may not be necessary to provide a second zone of combustion. The usage of the mixing tube 34 can be controlled based on the load applied on the gas turbine 100. For example, this can be accomplished by providing an opening/closing mechanism 42 (e.g., a valve) to cut off the supply of fuel 4 to the mixing tube 34 when the load on the gas turbine 100 is low and to feed fuel 4 into the mixing tube 34 when the load exceeds the predetermined level. Thus, the supply of fuel can be activated and deactivated. Moreover, the volume rate of fuel 4 into the mixing tube 34 may be controlled to obtain a desired ratio of fuel to air. For example, the ratio of fuel to air at the secondary combustion chamber 28 supplied by the mixing tube 34 may be 0.035 compared to a ratio of 0.03 in the primary combustion chamber 26. Such ratio may also be controlled by adjusting a size of an opening of the opening/closing mechanism 42.

By providing a secondary supply of fuel 4 into the combustor, and more specifically disposing the outlet 34*b* of the mixing tube 34 to provide a supply of fuel 4 into the secondary combustion chamber 28 (or a downstream part of the primary combustion chamber 26 as described above and shown in FIG. 8), the mixing tube 34 creates a second zone of combustion in the combustion chamber downstream of the first zone of combustion formed in the first combustion chamber 26 near the head end 12. This change involves adding less fuel to the primary combustion chamber 26 and, as a result, the combustion temperature at the primary combustion chamber 26 can be lowered thereby decreasing the level of $NO_X$ emissions. Moreover, the residence time of the fuel-air mixture 6 exiting from the mixing tube 34 is shorter because the distance traveled by the mixture 6 from the outlet 34*b* to the exit of the secondary combustor liner 20 (or entrance of the turbine section 14) is shorter compared to the distance traveled by the mixture 6 of fuel 4 and air 2 formed in the primary combustion chamber 26. Thus, since the level of $NO_X$ emissions is in part proportional to the length of time spent at elevated temperatures, the shorter residence time results in less $NO_X$ emitted in the secondary combustion chamber 28. The location of the outlet 34*b* may be controlled to adjust the residence time of the fuel-air mixture 6. For example, the residence time may be 6 milliseconds or less, or less than 4 to 6 milliseconds.

The invention has been described with reference to the example embodiments described above. Modifications and alterations will occur to others upon a reading and understanding of this specification. Example embodiments incorporating one or more aspects of the invention are intended to include all such modifications and alterations insofar as they come within the scope of the appended claims.

What is claimed is:

1. A combustor section of a gas turbine including:

a primary combustor liner defining a primary combustion chamber;

a secondary combustor liner defining a secondary combustion chamber downstream from and connected to the primary combustor liner in fluid communication therewith;

a primary sleeve surrounding the primary combustor liner;

a secondary sleeve surrounding the secondary combustor liner and connected to the primary sleeve, the combustor liners and the sleeves defining an annular flow space therebetween; and a fuel-air mixing tube configured to channel a mixture of fuel and air and including an inlet and an outlet, the inlet located to directly open in fluid communication with an exterior of the primary sleeve, and the outlet located to directly open in fluid communication with the secondary combustion chamber.

2. The combustor section of claim 1, further including a combustor casing enclosing the sleeves so as to channel air thereto, the combustor casing enclosing at least the inlet of the mixing tube and a part of the combustor section downstream of the inlet, the primary and secondary sleeves and the combustor casing defining a discharge air space therebetween, the discharge air space in fluid communication with the fuel-air mixing tube.

3. The combustor section of claim 1, the mixing tube including a plurality of tube segments.

4. The combustor section of claim 3, the tube segments joined in a sealed manner and allowing relative movement about one another.

5. The combustor section of claim 1, a substantial portion of the mixing tube located within the annular flow space.

6. The combustor section of claim 5, the mixing tube routed through the primary sleeve near the inlet.

7. The combustor section of claim 1, a substantial portion of the mixing tube located outside the annular flow space.

8. The combustor section of claim 7, the mixing tube routed through the secondary sleeve near the outlet.

9. The combustor section of claim 1, the mixing tube located in part within the annular flow space and in part outside the annular flow space.

10. The combustor section of claim 1, the outlet located about the secondary sleeve such that a residence time of the fuel-mixture is not more than 6 milliseconds.

11. The combustor section of claim 1, further including a plurality of mixing tubes scattered peripherally about the combustor section.

12. A gas turbine including:

a combustor section including:

a combustor liner defining a combustion chamber;

a sleeve surrounding the combustor liner, the combustor liner and the sleeve defining an annular flow space therebetween; and a fuel-air mixing tube configured to channel a mixture of fuel and air and including an inlet and an outlet, the inlet located to directly open in fluid communication with an exterior of a primary sleeve of the sleeve, and the outlet located to directly open in fluid communication with a secondary combustion chamber aft of the primary sleeve;

a combustor casing enclosing the combustor section upstream relative to the inlet of the mixing tube and extending downstream therefrom, the sleeve and the combustor casing defining a discharge air space therebetween, the discharge air space in fluid communication with the fuel-air mixing tube; and a fuel supplying device located exteriorly of the combustor casing and configured to inject fuel into the fuel-air mixing tube.

13. The gas turbine of claim 12, the fuel supplying device including an injector located at a distance from the inlet of the fuel-air mixing tube, the fuel supplying device configured to activate or deactivate injection of fuel into the fuel-air mixing tube.

14. The gas turbine of claim 12, the mixing tube including a plurality of tube segments.

15. The gas turbine of claim 14, the tube segments joined in a sealed manner and allowing relative movement about one another.

16. The gas turbine of claim 12, the outlet located about the sleeve such that a residence time of the fuel-mixture is not more than 6 milliseconds.

17. The gas turbine of claim 12, further including a turbine section downstream of the combustor section, the outlet of the mixing tube located in proximity with the turbine section.

18. The gas turbine of claim 12, the combustor liner including a primary combustor liner and a secondary combustor liner downstream of the primary combustor liner, the sleeve including the primary sleeve and a secondary sleeve downstream of the primary sleeve, the primary combustor liner defining a primary combustion chamber, the secondary combustor liner defining the secondary combustion chamber, the outlet of the mixing tube in fluid communication with the primary combustion chamber.

19. A method of supplying a mixture of fuel and air to a combustor section of a gas turbine, the combustor section including a primary combustor liner defining a primary combustion chamber, a secondary combustor liner defining a secondary combustion chamber downstream from and connected to the primary combustor liner in fluid communication therewith, a primary sleeve surrounding the primary combustor liner, and a secondary sleeve surrounding the secondary combustor liner and connected to the primary sleeve, the combustor liners and the sleeves defining an annular flow space therebetween, the method including the steps of:

providing a mixing tube including an inlet and an outlet, the inlet located to directly open in fluid communication with an exterior of the primary sleeve, the outlet located to directly open in fluid communication with the secondary combustion chamber; and supplying fuel and air to the inlet.

20. The method of claim 19, further including the step of disposing the outlet about the secondary combustion chamber such that a residence time of the mixture of fuel and air is 6 milliseconds or less.

* * * * *